US009843869B2

(12) United States Patent
Wei et al.

(10) Patent No.: US 9,843,869 B2
(45) Date of Patent: Dec. 12, 2017

(54) THERMOACOUSTIC DEVICE

(71) Applicants: Tsinghua University, Beijing (CN); HON HAI PRECISION INDUSTRY CO., LTD., New Taipei (TW)

(72) Inventors: Yang Wei, Beijing (CN); Hao-Ming Wei, Beijing (CN); Xiao-Yang Lin, Beijing (CN); Shou-Shan Fan, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/641,334

(22) Filed: Jul. 5, 2017

(65) Prior Publication Data

US 2017/0303050 A1 Oct. 19, 2017

Related U.S. Application Data

(62) Division of application No. 14/609,600, filed on Jan. 30, 2015.

(30) Foreign Application Priority Data

Jul. 21, 2014 (CN) ..... 2014 1 0346736

(51) Int. Cl.
*H04R 23/00* (2006.01)
*H04R 31/00* (2006.01)

(52) U.S. Cl.
CPC ..... *H04R 23/002* (2013.01); *H04R 31/006* (2013.01)

(58) Field of Classification Search
CPC ..... H04R 23/002
See application file for complete search history.

(56) References Cited

U.S. PATENT DOCUMENTS

| | | | | |
|---|---|---|---|---|
| 9,394,176 | B2 * | 7/2016 | Wei | C01B 31/0253 |
| 9,481,125 | B2 * | 11/2016 | Wei | B29C 59/005 |
| 2010/0172840 | A1 * | 7/2010 | Sitharaman | A61K 49/0423 424/9.1 |
| 2013/0050113 | A1 * | 2/2013 | Brown | B82Y 30/00 345/173 |
| 2015/0132393 | A1 * | 5/2015 | Trigueros | A61K 9/14 424/490 |

* cited by examiner

*Primary Examiner* — Seahvosh Nikmanesh
(74) *Attorney, Agent, or Firm* — Steven Reiss

(57) ABSTRACT

A thermoacoustic device includes a substrate, a first electrode and a second electrode, at least two supporting members, and a first carbon nanotube film. The substrate includes a surface. The first electrode and the second electrode are located on the surface of the substrate and spaced from each other. The at least two supporting members are spaced from each other and respectively located on surfaces of the first electrode and the second electrode. The at least two supporting members include a plurality of carbon nanotubes parallel with each other and substantially perpendicular to the surface of the substrate. The first carbon nanotube film is supported by the at least two supporting members and has a portion between the at least two supporting members suspended above the substrate. The supporting members electrically connect the first carbon nanotube film with the first electrode and the second electrode.

11 Claims, 9 Drawing Sheets

THERMOACOUSTIC DEVICE

CROSS-REFERENCE TO RELATED APPLICATIONS

This application is a division application of U.S. patent application Ser. No. 14/609,600, filed on Jan. 30, 2015, entitled "THERMOACOUSTIC DEVICE AND METHOD FOR MAKING THE SAME," which all benefits accruing under 35 U.S.C. §119 from China Patent Application No. 201410346736.4, filed on Jul. 21, 2014 in the China Intellectual Property Office, the contents of which are hereby incorporated by reference.

FIELD

The subject matter herein generally relates to thermoacoustic devices and methods for making the same.

BACKGROUND

Thermoacoustic device is based on thermoacoustic effect having a conversion of heat into acoustic signals and distinct from the mechanism of conventional loudspeakers, in which the pressure waves are created by the mechanical movement of the diaphragm. When signals are supplied to a thermoacoustic element of the device, heat is produced in the thermoacoustic element according to the variations of the signal and/or signal strength. The heat propagates into surrounding medium. The heating of the medium causes thermal expansion and produces pressure waves in the surrounding medium, resulting in sound wave generation. Such an acoustic effect induced by temperature waves is commonly called "the thermoacoustic effect". Xiao et al. discloses an thermoacoustic device with simpler structure and smaller size, working without the magnet in an article of "Flexible, Stretchable, Transparent Carbon Nanotube Thin Film Loudspeakers", Xiao et al., Nano Letters, Vol. 8 (12), 4539-4545 (2008). The thermoacoustic device has a carbon nanotube film as the thermoacoustic element. The carbon nanotube film used in the thermoacoustic device has a large specific surface area, and extremely small heat capacity per unit area that make the sound wave generator emit sound audible to humans. Accordingly, the thermoacoustic device adopted the carbon nanotube film has a potential to be actually used instead of the loudspeakers in prior art.

BRIEF DESCRIPTION OF THE DRAWING

Implementations of the present technology will now be described, by way of example only, with reference to the attached figures, wherein.

DETAILED DESCRIPTION

Figure 1:
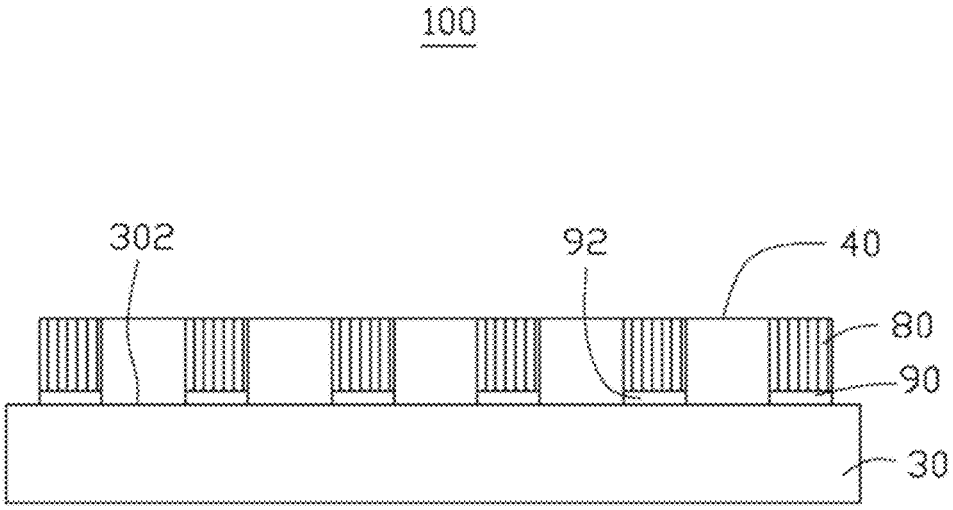
FIG. 1 is a schematic side view of an embodiment of a thermoacoustic device.

The disclosure is illustrated by way of example and not by way of limitation in the figures of the accompanying drawings in which like references indicate similar elements. It should be noted that references to "another," "an," or "one" embodiment in this disclosure are not necessarily to the same embodiment, and such references mean "at least one."

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "contact" is defined as a direct and physical contact. The term "substantially" is defined to be essentially conforming to the particular dimension, shape, or other description that is described, such that the component need not be exactly conforming to the description. The term "comprising," when utilized, means "including, but not necessarily limited to"; it specifically indicates open-ended inclusion or membership in the so-described combination, group, series, and the like.

Referring to FIG. 1, the present disclosure is described in relation to a thermoacoustic device 100. The thermoacoustic device 100 comprises a substrate 30 (e.g., a base), a first electrode 90, a second electrode 92, at least two supporting members 80, and a first carbon nanotube film 40. The first electrode 90 and the second electrode 92 are located on a same surface 302 of the substrate 30 and spaced from each other. The at least two supporting members 80 are spaced from each other and respectively located on surfaces of the first electrode 90 and the second electrode 92. The first carbon nanotube film 40 are located on surfaces of the at least two supporting members 80 and supported by the at least two supporting members 80. A portion of the first carbon nanotube film 40 between the two supporting members 80 are suspended above the substrate 30. The supporting members 80 are electrically conductive and electrically connecting the first carbon nanotube film 40 with the first and second electrodes 90, 92. The supporting members 80 comprise a plurality of carbon nanotubes that are wall by wall and parallel with each other. The plurality of carbon nanotubes are substantially perpendicular to the surface 302 of the substrate 30.

The material of the substrate 30 can be at least one of soft, elastic, and rigid solid substrate, such as metal, glass, crystal, ceramic, silicon, silicon dioxide, plastic, and resin, such as polymethyl methacrylate, poly(dimethylsiloxane) (PDMS) and polyethylene terephthalate. In one embodiment, the substrate 30 is electrically insulating. In another embodiment, an insulating layer is located between the substrate 30 and the first and second electrodes 90, 92 to electrically insulate the first and second electrodes 90, 92 from the substrate 30.

The first and second electrodes 90, 92 are made of conducting material, such as metal, conducting polymer, conducting binder, metallic carbon nanotubes, and tin indium oxide (ITO). The first and second electrodes 90, 92 are respectively connected with the first carbon nanotube film 40 to input electrical signals to the carbon nanotube film 40. Shapes of the first and second electrodes 90, 92 are not limited. In one embodiment, the first and second electrodes 90, 92 are strip shaped layers spaced and parallel to each other. The lengths of the first and second electrodes 90, 92 can be larger than or equal to the width of the carbon nanotube film 40. The thicknesses of the first and second electrodes 90, 92 can be in a range from about 1 micron to about 1 millimeter. The widths of the first and second electrodes 90, 92 can be in a range from about 5 microns to about 1 millimeter.

The thermoacoustic device 100 can comprise a plurality of first electrodes 90 and a plurality of second electrodes 92 alternatively arranged and spaced from each other. One first electrode 90 is located between each two adjacent second electrodes 92, and one second electrode 92 is located between each two adjacent first electrodes 90.

The at least two supporting members 80 have shapes substantially according to the shapes of the first and second electrodes 90, 92. In one embodiment, the supporting members 80 are strip shaped members spaced and parallel to each other. The lengths of the supporting members 80 can be larger than or equal to the width of the carbon nanotube film 40. The heights of the supporting members 80 can be in a range from about 10 microns to about 5 millimeters. The supporting members 80 are formed by patterning a carbon nanotube array and comprise a plurality of carbon nanotubes combined with van der Waals attractive forces. The heights of the supporting members 80 are the height of the carbon nanotube array (i.e., the lengths of the carbon nanotubes in the carbon nanotube array). The widths of the supporting members 80 can be as small as several microns, such as in a range from about 5 microns to about 1 millimeter. Due to the excellent conductivity of the carbon nanotubes that are substantially perpendicular to the surfaces of the carbon nanotube film 40 and the first and second electrodes 90, 92, an excellent electrical connection between the carbon nanotube film 40 and the first and second electrodes 90, 92 can be formed through the supporting members 80. An amount of the supporting members 80 is the total amount of the first and second electrodes 90, 92. Each of the first and second electrodes 90, 92 has a supporting member 80 located thereon. Thus, the functions of the supporting members 80 are suspending the first carbon nanotube film 40 and conducting every first and second electrodes 90, 92 with the first carbon nanotube film 40. The supporting member 80 that is in contact with the first electrode 90 is not in contact with the second electrode 92 or the supporting member 80 that is in contact with the second electrode 92, but spaced from the second electrode 92 or the supporting member 80 that is in contact with the second electrode 92. The first carbon nanotube film 40 cannot be short circuited between the first electrode 90 and the second electrode 92.

The first carbon nanotube film 40 comprises a plurality of carbon nanotubes joined end to end and is a macroscopic assembly of carbon nanotubes. The first carbon nanotube film 40 is free-standing, located on surfaces of the supporting members 80, and supported by the supporting members 80. The first carbon nanotube film 40 located between the two adjacent supporting members 80 is suspended. In use, the electrical signals are conducted from the first electrode 90 to the first carbon nanotube film 40 through one supporting member 80 and then conducted from the first carbon nanotube film 40 through another supporting member 80 to the second electrode 92. The carbon nanotubes in the first carbon nanotube film 40 are substantially parallel to the surface of the first carbon nanotube film 40 and substantially aligned along the same direction. The width direction of the first carbon nanotube film 40 is substantially perpendicular to the aligned direction of the carbon nanotubes. In one embodiment, the carbon nanotubes are substantially aligned along a direction from the first electrode 90 to the second electrode 92.

The first carbon nanotube film 40 is a thermoacoustic element that is capable of converting the electrical signals into heat signals to produce sounds by heating surrounding medium, such as ambient air. The first carbon nanotube film 40 has a very small heat capacity per unit area (e.g., less than $2\times10^{-4}$ J/cm$^2$*K) to rapidly increase and decrease temperature thereof with the frequency of the electrical signals. The first carbon nanotube film 40 has a small thickness (e.g., from about 0.5 nanometers to about 500 microns) and a large specific surface area (e.g., above 30 m$^2$/g), to propagate heat into surrounding medium, heats the surrounding medium at the frequency. The heating of the surrounding medium causes thermal expansion and produces pressure waves in the surrounding medium, resulting in sound wave generation.

Figure 2:
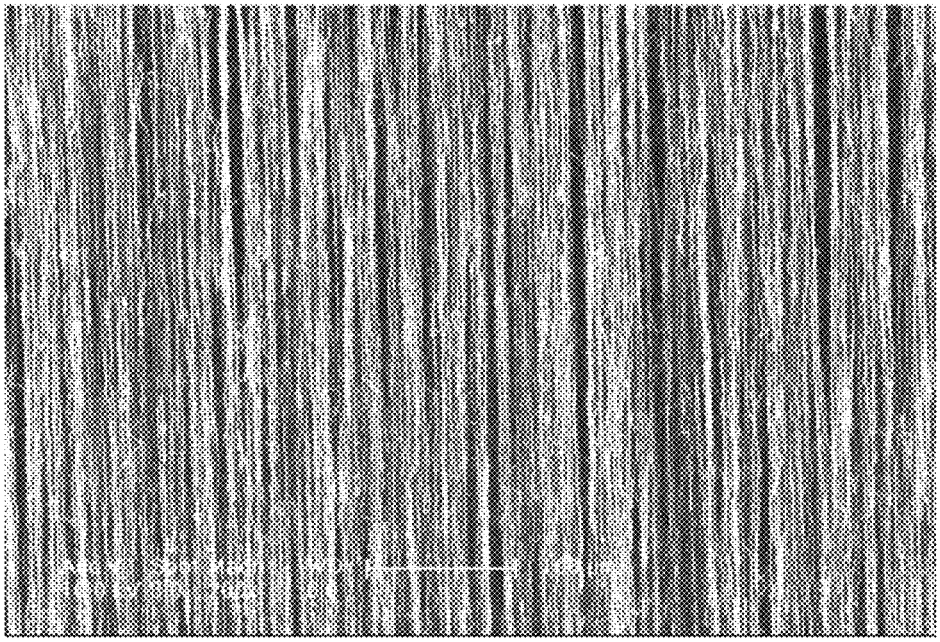
FIG. 2 shows a scanning electron microscope (SEM) image of a carbon nanotube film drawn from the carbon nanotube array.
Figure 3:
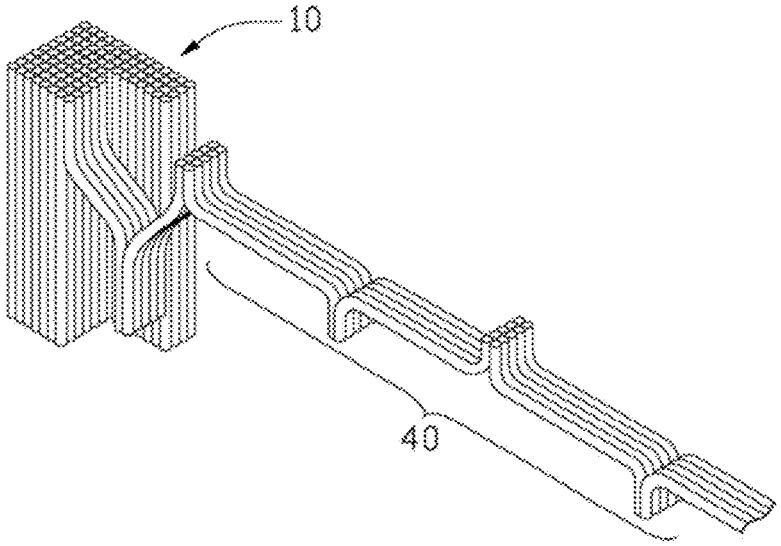
FIG. 3 shows a schematic structure view of one embodiment of carbon nanotubes joined end-to-end.

The first carbon nanotube film 40 can be drawn from a carbon nanotube array that is capable of having a film drawn therefrom and comprises or consists a plurality of successive and aligned carbon nanotubes joined end-to-end by van der Waals attractive force therebetween. Referring to FIG. 2 and FIG. 3, the overall aligned direction of a majority of the carbon nanotubes is substantially aligned along the same direction parallel to a surface of the first carbon nanotube film 40. A majority of the carbon nanotubes are substantially aligned along the same direction in the first carbon nanotube film 40. Along the aligned direction of the majority of carbon nanotubes, each carbon nanotube is joined to adjacent carbon nanotubes end to end by van der Waals attractive force therebetween, whereby the first carbon nanotube film 40 is capable of being free-standing structure. There may be a minority of carbon nanotubes in the first carbon nanotube film 40 that are randomly aligned. However, the number of the randomly aligned carbon nanotubes is very small, in comparison, and does not affect the overall oriented alignment of the majority of carbon nanotubes in the first carbon nanotube film 40. Some of the majority of the carbon nanotubes in the carbon nanotube film that are substantially aligned along the same direction may not be exactly straight, and can be curved at a certain degree, or not exactly aligned along the overall aligned direction by a certain degree. Therefore, partial contacts can exist between the juxtaposed carbon nanotubes in the majority of the carbon nanotubes aligned along the same direction in the first carbon nanotube film 40. The first carbon nanotube film 40 can comprise a plurality of successive and oriented carbon nanotube segments. The plurality of carbon nanotube segments are joined end to end by van der Waals attractive force. Each carbon nanotube segment comprises a plurality of carbon nanotubes substantially parallel to each other, and the plurality of paralleled carbon nanotubes are in contact with each other and combined by van der Waals attractive force therebetween. The carbon nanotube segment has a desired length, thickness, uniformity, and shape. There can be clearances between adjacent and juxtaposed carbon nanotubes in the first carbon nanotube film 40. In one embodiment, the first carbon nanotube film 40 has a specific surface area ranged from 200 $m^2/g$ to 2600 $m^2/g$. The specific surface area of the first carbon nanotube film 40 is tested by a Brunauer-Emmet-Teller (BET) method. In one embodiment, the first carbon nanotube film 40 has a specific weight of about 0.05 $g/m^2$. The first carbon nanotube film 40 is a free-standing structure. The term "free-standing" comprises, but is not limited to, a structure that does not have to be supported by a substrate and can sustain the weight of it when it is hoisted by a portion thereof without any significant damage to its structural integrity. The suspended part of the first carbon nanotube film 40 will have more sufficient contact with the surrounding medium (e.g., air) to have heat exchange with the surrounding medium from both sides of the first carbon nanotube film 40.

Figure 4:
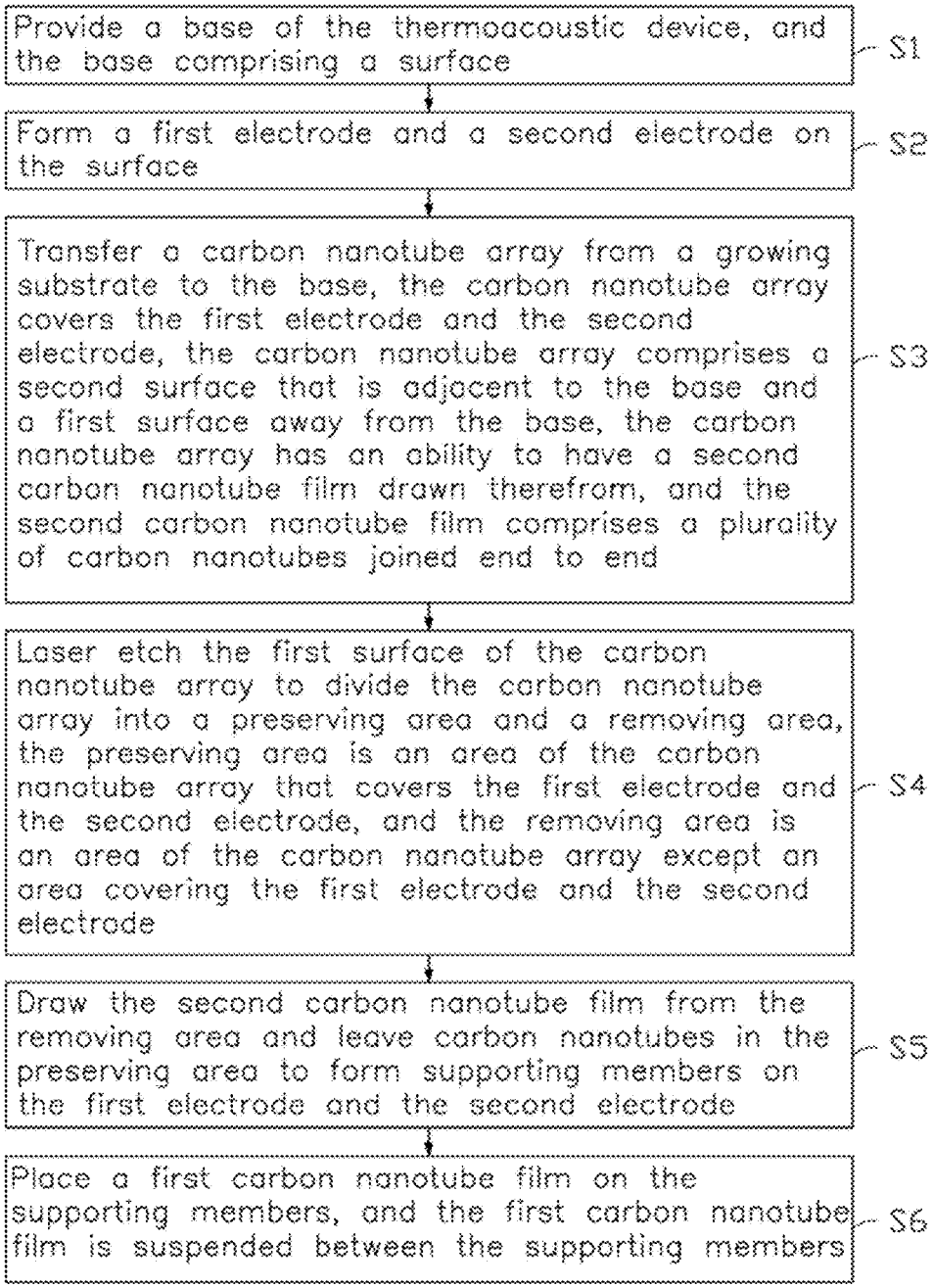
FIG. 4 is a flow chart of an embodiment of a method for making the thermoacoustic device.
Figure 5:
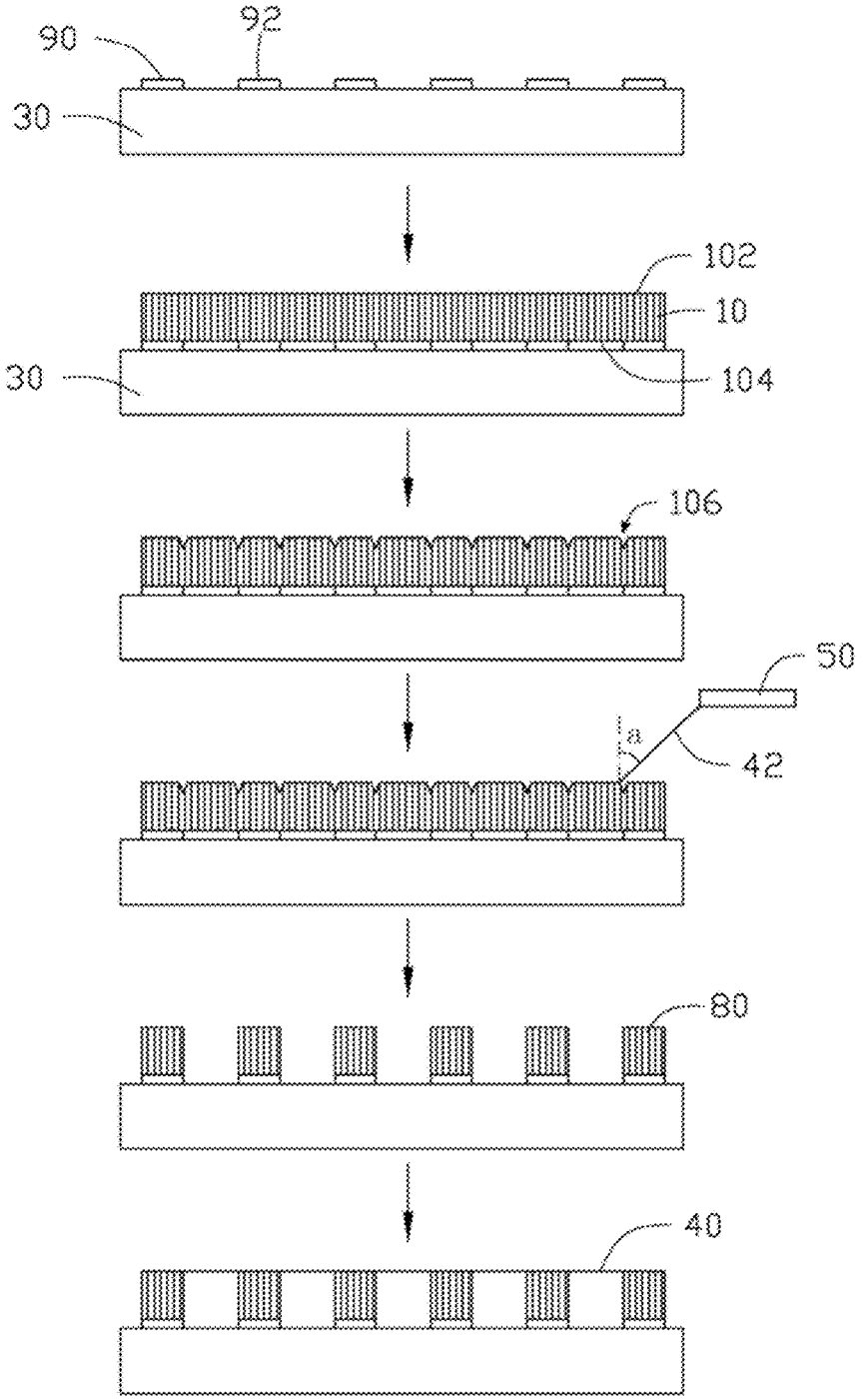
FIG. 5 is a schematic side view of an embodiment of the method for making the thermoacoustic device.
Figure 6:
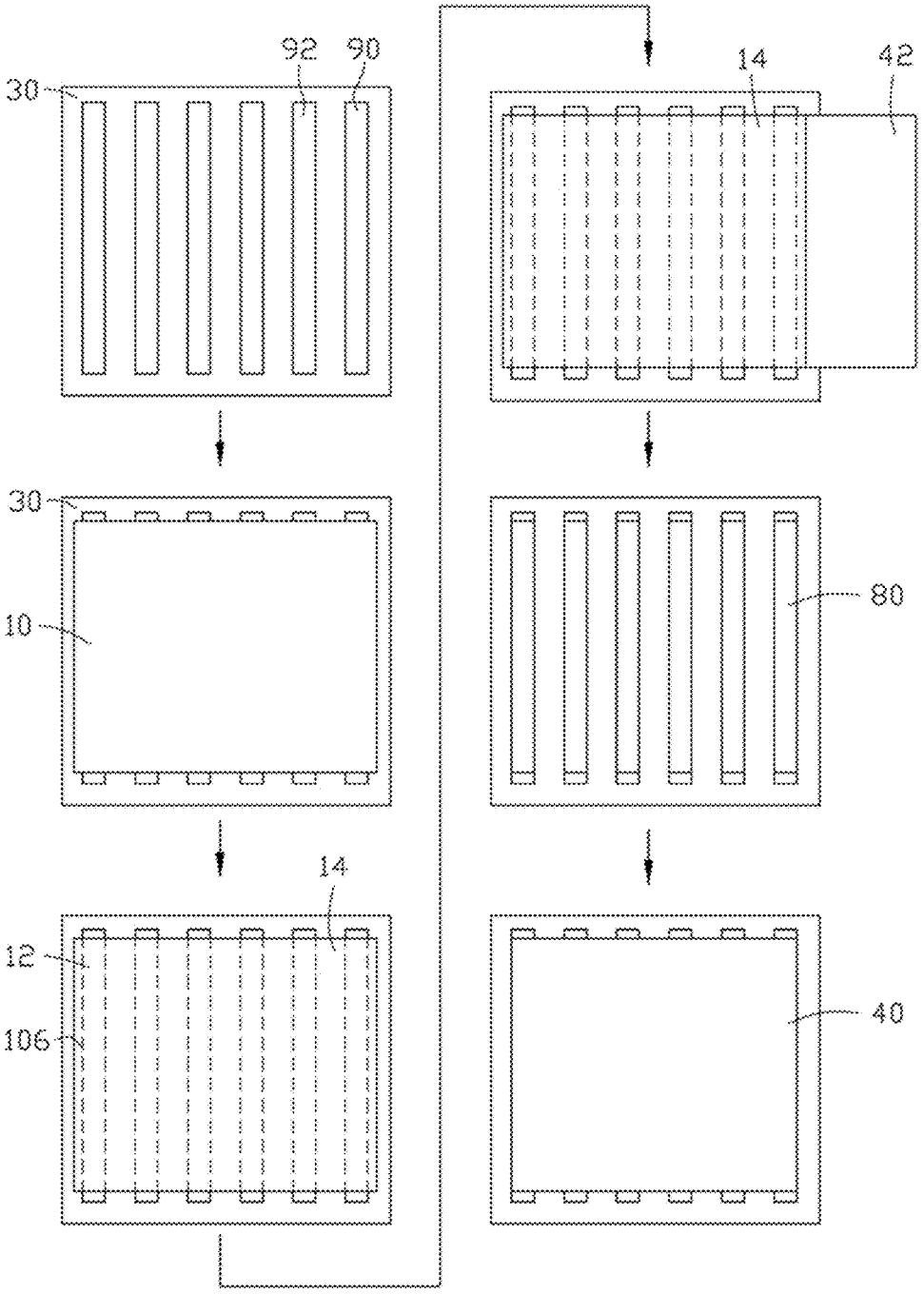
FIG. 6 is a schematic top view of an embodiment of the method for making the thermoacoustic device.

Referring to FIG. 4 to FIG. 6, the present disclosure is described in relation to a method for making the thermoacoustic device 100.

In block S1, the substrate 30 of the thermoacoustic device 100 is provided. The substrate 30 has a surface 302.

In block S2, the first and second electrodes 90, 92 are formed on the surface 302 of the substrate 30. The first and second electrodes 90, 92 can be formed by coating, printing, depositing, etching, or plating method.

In block S3, a carbon nanotube array 10 is transferred onto the substrate 30 and covers the first electrode 90 and the second electrode 92. The carbon nanotube array 10 has a second surface 104 adjacent to the substrate 30 and a first surface 102 away from the substrate 30. The carbon nanotube array 10 has an ability to have a second carbon nanotube film 42 drawn therefrom. The second carbon nanotube film 42 comprises a plurality of carbon nanotubes joined end to end.

In block S4, the first surface 102 of the carbon nanotube array 10 is laser etched to divide the carbon nanotube array 10 into two areas which are a preserving area 12 and a removing area 14. The preserving area 12 is the area of the carbon nanotube array 10 that covers the first electrode 90 and the second electrode 92. The removing area 14 is the area the carbon nanotube array 10 other than that covers the first electrode 90 and the second electrode 92.

In block S5, a second carbon nanotube film 42 is drawn from the removing area 14, thus removing the carbon nanotubes in the removing area 14 and leaving carbon nanotubes in the preserving area to form the supporting members 80 on the first and second electrodes 90, 92.

In block S6, the first carbon nanotube film 40 is placed on the supporting members 80 and suspended between the supporting members 80.

The second carbon nanotube film 42 can be a free-standing structure including a plurality of carbon nanotubes joined end-to-end by van der Waals attractive force therebetween. The second carbon nanotube film 42 and the first carbon nanotube film 40 can have a same structure and can be drawn from different carbon nanotube arrays.

Transferring of Carbon Nanotube Array

Figure 7:
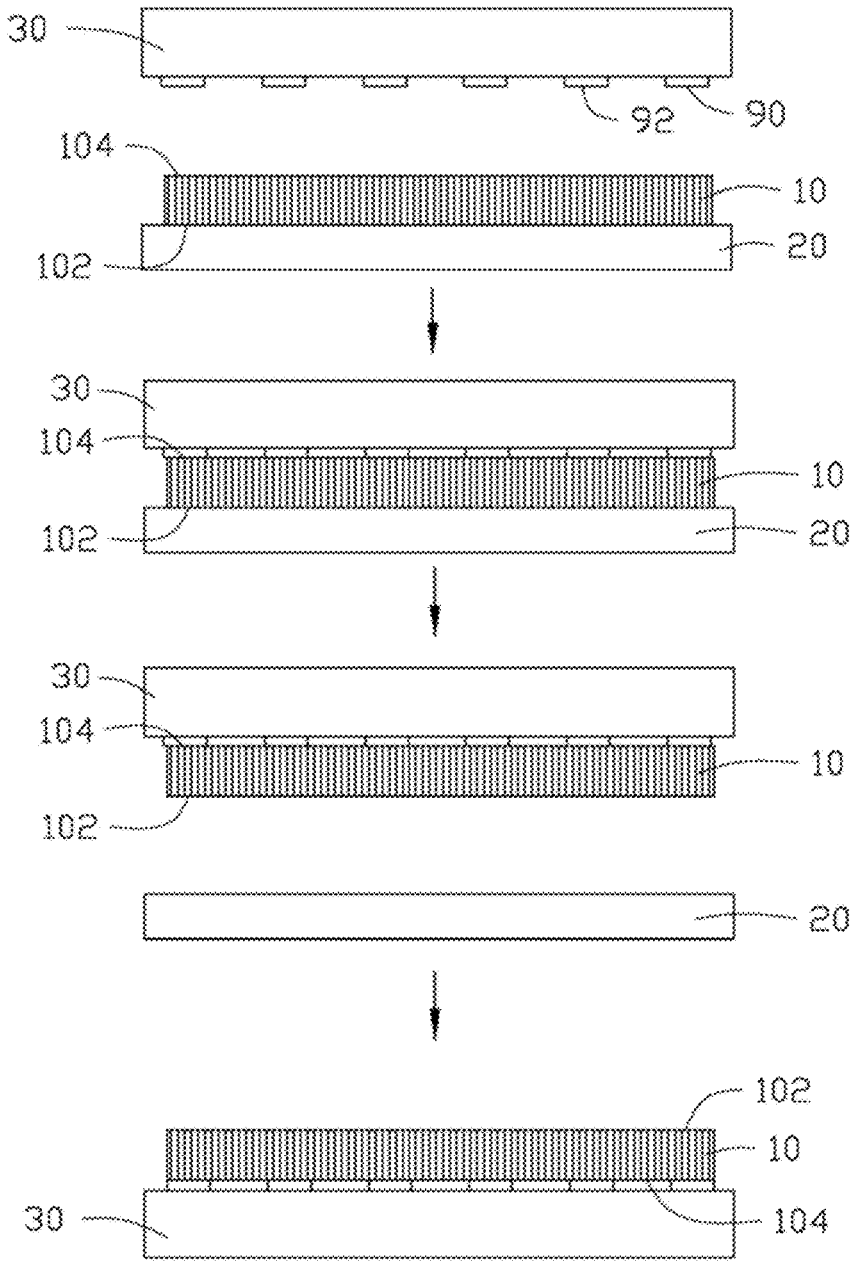
FIG. 7 is a schematic side view of an embodiment of a method for transferring the carbon nanotube array.

Referring to FIG. 7, in block S3, the carbon nanotube array 10 is originally grown/formed on a growing substrate 20 and is transferred to the substrate 30.

First, the growing substrate 20, having the carbon nanotube array 10 grown thereon is provided. The first surface 102 of the carbon nanotube array 10 is on the growing substrate 20. The second surface 104 of the carbon nanotube array 10 is away from the growing substrate 20. The carbon nanotube array 10 is grown to have a state/shape/form that is capable of having a second carbon nanotube film 42 drawn therefrom. The carbon nanotube array 10 is transferred from growing substrate 20 to the substrate 30 and the state/shape/form of the carbon nanotube array 10, before, during, and after the transfer onto the substrate 30, is still capable of having the second carbon nanotube film 42 drawn therefrom.

The carbon nanotube array 10 is grown on the growing substrate 20 by a chemical vapor deposition (CVD) method. The carbon nanotube array 10 comprises a plurality of carbon nanotubes oriented substantially perpendicular to a growing surface of the growing substrate 20. The carbon nanotubes in the carbon nanotube array 10 are closely bonded together side-by-side by van der Waals attractive forces. By controlling growing conditions, the carbon nanotube array 10 can be essentially free of impurities such as carbonaceous or residual catalyst particles. Accordingly, the carbon nanotubes in the carbon nanotube array 10 are closely contacting each other, and a relatively large van der Waals attractive force exists between adjacent carbon nanotubes. The van der Waals attractive force is so large that when drawing a carbon nanotube segment (e.g., a few carbon nanotubes arranged side-by-side), adjacent carbon nanotube segments can be drawn out end-to-end from the carbon nanotube array 10 due to the van der Waals attractive forces between the carbon nanotubes. The carbon nanotubes are continuously drawn to form a free-standing and macroscopic second carbon nanotube film 42. The carbon nanotube array 10, that can have the second carbon nanotube film 42 drawn therefrom, can be a super aligned carbon nanotube array. A material of the growing substrate 20 can be P-type silicon, N-type silicon, or other materials that are suitable for growing the super aligned carbon nanotube array.

In the present disclosure, the growing of the carbon nanotube array 10 and the drawing of the second carbon nanotube film 42 are processed on different structures (i.e., the growing substrate 20 and the substrate 30). The substrate 30 for drawing the second carbon nanotube film 42 can be made of low-price materials, and the growing substrate 20 can be recycled quickly. Thus, production of the second carbon nanotube film 42 can be optimized.

The substrate 30 has the surface 302 to accept the carbon nanotube array 10 thereon. The surface 302 of the substrate 30 can be flat when the carbon nanotube array 10 is grown on a flat growing surface 202 of the growing substrate 20. During transferring of the carbon nanotube array 10 from the growing substrate 20 to the substrate 30, the state of the carbon nanotube array 10 is still capable of drawing the second carbon nanotube film 42 from the carbon nanotube array 10 on the substrate 30. The carbon nanotube array 10 transferred to the substrate 30 is still a super aligned carbon nanotube array. The carbon nanotubes of the carbon nanotube array 10 are substantially perpendicular to the surface of the substrate 30.

The carbon nanotube array 10 is arranged upside down on the surface 302 of the substrate 30. The carbon nanotubes are grown from the growing surface 202 of the growing substrate 20 to form the carbon nanotube array 10. The carbon nanotube comprises a bottom end adjacent or contacting the growing substrate 20 and a top end away from the growing substrate 20. The bottom ends of the carbon nanotubes form the first surface 102 of the carbon nanotube array 10, and the top ends of the carbon nanotubes form the second surface 104 of the carbon nanotube array 10. After the carbon nanotube array 10 is transferred to the substrate 30, the second surface 104 of the carbon nanotube array 10 is now adjacent to or contacting the substrate 30, and the first surface 102 of the carbon nanotube array 10 is now away from the substrate 30.

In one embodiment, the carbon nanotube array 10 is transferred by:

contacting the surface 302 of the substrate 30 to the second surface 104 of the carbon nanotube array 10; and separating the substrate 30 from the growing substrate 20, thereby separating the first surface 102 of the carbon nanotube array 10 from the growing substrate 20 to transfer the carbon nanotube array 10 from the growing substrate 20 to the substrate 30.

The carbon nanotube array 10 can be transferred from the growing substrate 20 to the substrate 30 at room temperature (e.g., 10° C. to 40° C.).

The surface 302 of the substrate 30 and the second surface 104 of the carbon nanotube array 10 can be bonded only by van der Waals attractive forces, and a bonding force ($F_{BC}$) between the carbon nanotube array 10 and the substrate 30 is smaller than the van der Waals attractive forces ($F_{CC}$) between the carbon nanotubes in the carbon nanotube array 10. Meanwhile, the bonding force $F_{BC}$ is larger than the bonding force ($F_{AC}$) between the carbon nanotube array 10 and the growing substrate 20, to separate the carbon nanotube array 10 from the growing substrate 20. Therefore, $F_{AC}<F_{BC}<F_{CC}$ must be satisfied.

To satisfy $F_{AC}<F_{BC}<F_{CC}$, the substrate 30 can have a suitable surface energy and a suitable interface energy can exist between the substrate 30 and the carbon nanotube array 10. Thus, the substrate 30 can generate enough bonding force (e.g., van der Waals attractive force) with the carbon nanotube array 10 simply by contacting the carbon nanotube array 10. A suitable material of the substrate 30 must have a sufficient bonding force $F_{BC}$ (e.g., van der Waals attractive force) with the second surface 104 of the carbon nanotube array 10 to overcome the bonding force $F_{AC}$ between the carbon nanotube array 10 from the growing substrate 20. The surface 302 of the substrate 30 can be substantially flat. In one embodiment, the material of the substrate 30 is poly(dimethylsiloxane) (PDMS).

The substrate 30 can adhere to the carbon nanotube array 10 without another substance (e.g., an adhesive binder) and only by van der Waals attractive forces. Although the adhesive binder can have a bonding force with the carbon nanotube array 10 greater than the bonding force between the carbon nanotube array 10 and the growing substrate 20, because the van der Waals attractive force between the carbon nanotubes in the carbon nanotube array 10 is small, the bonding force provided by the adhesive binder may be too great (i.e., greater than the bonding force $F_{CC}$ between the carbon nanotubes in the carbon nanotube array 10). In this situation, the second carbon nanotube film 42 cannot be drawn from the transferred carbon nanotube array 10. During the transferring, the substrate 30 can always be in a solid state.

In one embodiment, to satisfy $F_{AC}<F_{BC}<F_{CC}$, the substrate 30 can increase the surface area of the surface 302 by using the microstructures 304, thus increasing the $F_{BC}$. The substrate 30 can have the surface 302 with a plurality of microstructures 304 located thereon. The microstructure 304 can have a point shape and/or a long and narrow shape, and can be protrusions and/or recesses. The cross section of the microstructures 304 can be semicircular, rectangular, conical, and/or stepped. The microstructures 304 can be hemispheres, convex or concave columns, pyramids, pyramids without tips, and any combination thereof. In one embodiment, the microstructures 304 can be parallel and spaced grooves. In another embodiment, the microstructures 304 can be uniformly spaced hemispherical protrusions. The plurality of microstructures 304 are uniformly distributed on the surface 302 of the substrate 30. In one embodiment, the surface 302 having the microstructures 304 located thereon has a surface area of 30% to 120% more than a smooth surface of equivalent area. The surface 302 sufficiently contacts the second surface 104 of the carbon nanotube array 10. Thus, the material of the substrate 30 is not limited to PDMS and can be other conventional substrate materials such as soft, elastic, and rigid solid materials.

The height of the protrusion and the depth of the recess of the microstructures 304 can be 0.5% to 10% of the height of the carbon nanotube array 10. In one embodiment, the height of the protrusion and the depth of the recess can be in a range from about 5 microns to about 50 microns. The surface 302 needs an overall flatness to sufficiently contact the second surface 104 of the carbon nanotube array 10. The microstructures 304 can be formed on the surface 302 by laser etching, chemical etching, or lithography.

The microstructures 304 make the surface 302 of the substrate 30 relatively rough. When the recessed portion of the surface 302 is in contact with the second surface 104 of the carbon nanotube array 10, the protruded portion of the surface 302 may slightly curve the carbon nanotubes contacting the protruded portion. However, the microstructures 304 are small, so the curve is small, and when the substrate 30 and the growing substrate 20 are separated, the carbon nanotubes can elastically restore to a substantially straight shape and the carbon nanotube array 10 can restore to its original height. Thus, the state of the carbon nanotube array 10 is still capable of having the second carbon nanotube film 42 drawn from the carbon nanotube array 10.

To ensure almost all the top ends of the carbon nanotubes in the carbon nanotube array 10 have sufficient contact with the surface of the substrate 30, the substrate 30 and the growing substrate 20 can be brought close enough to each other. A distance from the surface 302 of the substrate 30 to the surface 202 of the growing substrate 20 can be less than or equal to the height of the carbon nanotube array 10 to apply a pressing force (f) to the carbon nanotube array 10. The pressing force f cannot be too large to ensure the state of the carbon nanotube array 10 is still capable of drawing the second carbon nanotube film 42 when transferred to the substrate 30. The pressing force is not to press the carbon nanotubes down or vary the length direction of the carbon nanotubes in the carbon nanotube array 10, otherwise the state of the carbon nanotube array 10 could change. Thus, the distance between the surface 302 of the substrate 30 and the surface 202 of the growing substrate 20 cannot be too small and should be larger than an extreme value. The extreme value is a value that causes the state of the carbon nanotube array 10 to be unable to draw the second carbon nanotube film 42.

However, the pressing force is difficult to control, and the height of the carbon nanotube array 10 is often in tens of microns to hundreds of microns. If the pressing force is too large, the carbon nanotubes in the array 10 may be pressed down. In one embodiment, a spacing element 22 is provided. The substrate 30 is spaced from the growing substrate 20 by the spacing element 22. The spacing element 22 is used to limit the distance between the surface 302 of the substrate 30 and the surface 202 of the growing substrate 20. The height of the spacing element 22 located between the substrate 30 and the growing substrate 20 is smaller than or equal to the height of the carbon nanotube array 10 and larger than the extreme value. A height distance (z) between the spacing element 22 and the carbon nanotube array 10 can exist. The spacing element 22 is a solid member. In one embodiment, the spacing element 22 is rigid. By controlling the height of the spacing element 22, the distance between the substrate 30 and the growing substrate 20 can be precisely controlled. The height (m) of the spacing element 22 can be 0.9 times to 1 time of the height (n) of the carbon nanotube array 10 (i.e., m=0.9 n to n).

During the pressing of the carbon nanotube array 10, the carbon nanotubes in the carbon nanotube array 10 are still substantially perpendicular to the growing surface of the growing substrate 20. When the height (m) is smaller than the height (n), the carbon nanotubes in the carbon nanotube array 10 can be pressed to be curved slightly. However, the curve is small and when the substrate 30 and the growing substrate 20 are separated, the carbon nanotubes can restore the straight shape and the carbon nanotube array 10 can restore the original height. Thus, the state of the carbon nanotube array 10 is still kept to be capable of having the second carbon nanotube film 42 drawn from the carbon nanotube array 10.

In one embodiment, the spacing element 22 is arranged on the growing substrate 20. In another embodiment, the spacing element 22 is arranged on the substrate 30. In yet another embodiment, the spacing element 22 can be a part of the growing substrate 20 or the substrate 30. A shape of the spacing element 22 is not limited and can be a block, a piece, a column, or a ball. There can be a plurality of spacing elements 22 uniformly arranged around the carbon nanotube array 10. The spacing element 22 can be a round circle around the carbon nanotube array 10. In another embodiment, the spacing elements 22 are a plurality of round columns uniformly arranged around the carbon nanotube array 10. The spacing element 22 can be used with or without the microstructures 304.

During the separating of the substrate 30 away from the growing substrate 20, a majority of the carbon nanotubes in the carbon nanotube array 10 can be detached from the growing substrate 20 at the same time by moving either the substrate 30, the growing substrate 20, or both, away from each other along a direction substantially perpendicular to the growing surface of the growing substrate 20. The carbon nanotubes of the carbon nanotube array 10 are detached from the growing substrate 20 along the growing direction of the carbon nanotubes. The two substrates both moves along the direction perpendicular to the growing surface of the growing substrate 20 and depart from each other.

Figure 8:
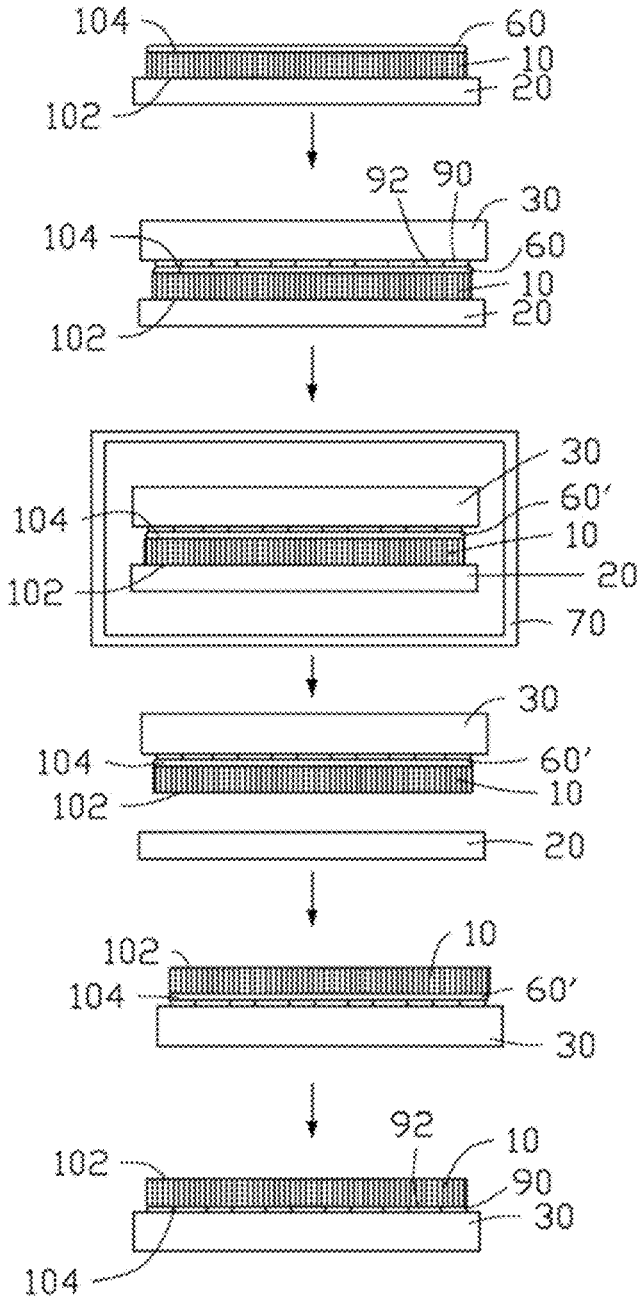
FIG. 8 is a schematic structural view of another embodiment of the method for transferring the carbon nanotube array.

Referring to FIG. 8, in another embodiment, the carbon nanotube array 10 is transferred by:

- placing the substrate 30 on the second surface 104 of the carbon nanotube array 10 and sandwiching liquid medium 60 between the substrate 30 and the carbon nanotube array 10;
- solidifying the liquid medium 60 between the substrate 30 and the carbon nanotube array 10 into solid medium 60';
- separating the substrate 30 from the growing substrate 20, thereby separating the first surface 102 of the carbon nanotube array 10 from the growing substrate 20; and
- removing the solid medium 60' between the substrate 30 and the carbon nanotube array 10.

The liquid medium 60 can be in a shape of fine droplets, mist, or film. The liquid medium 60 can spread on the entire second surface 104. The liquid medium 60 can be water and/or organic solvents with small molecular weights that are volatile at room temperature or easily evaporated by heating. The organic solvent can be selected from ethanol, methanol, and acetone. The liquid medium 60 has a poor wettability for carbon nanotubes. Thus, when a small amount of the liquid medium 60 is on the second surface 104 of the carbon nanotube array 10, it cannot infiltrate inside the carbon nanotube array 10 and will not affect the state of the carbon nanotube array 10. A diameter of the liquid droplet and a thickness of the liquid film can be in a range from about 10 nanometers to about 300 microns. The substrate 30 and the second surface 104 of the carbon nanotube array 10 are both in contact with the liquid medium 60.

During the placing the substrate 30 on the second surface 104, the substrate 30 may apply a pressing force as small as possible to the carbon nanotube array 10. The pressing force can satisfy $0<f<2N/cm^2$. The pressing force does not press the carbon nanotubes down or vary the length direction of the carbon nanotubes in the carbon nanotube array 10. The carbon nanotubes in the carbon nanotube array 10 between the substrate 30 and the growing substrate 20 are always substantially perpendicular to the growing surface of the growing substrate 20.

In one embodiment, the liquid medium 60 is formed on the second surface 104 of the carbon nanotube array 10. The liquid medium 60 can be formed into fine droplets or a mist in the air and drop or collect onto the second surface 104 of the carbon nanotube array 10. The substrate 30 and the carbon nanotube array 10 on the growing substrate 20 are brought together such that the surface of the substrate 30 and the liquid medium 60 on the second surface 104 are contacting each other.

In another embodiment, the liquid medium 60 is formed on the surface of the substrate 30. The liquid medium 60 can be formed into fine droplets or a mist in the air and drop or collect onto the surface of the substrate 30. The substrate 30 and the carbon nanotube array 10 on the growing substrate 20 are brought together such that the second surface 104 of the carbon nanotube array 10 and the liquid medium 60 on the surface of the substrate 30 are contacting each other.

During the solidifying of the liquid medium 60, the temperature of the liquid medium 60 can be decreased to below the freezing point of the liquid medium 60. After the liquid medium 60 is solidified, the substrate 30 and the carbon nanotube array 10 can be firmly bonded together by the solid medium 60' therebetween. In one embodiment, water is frozen into ice below 0° C.

In one embodiment, the laminate of the growing substrate 20, the carbon nanotube array 10, the liquid medium 60, and the substrate 30 can be arranged in an area, such as be put into a freezer 70, with a temperature below the freezing point to freeze the liquid medium 60.

Figure 9:
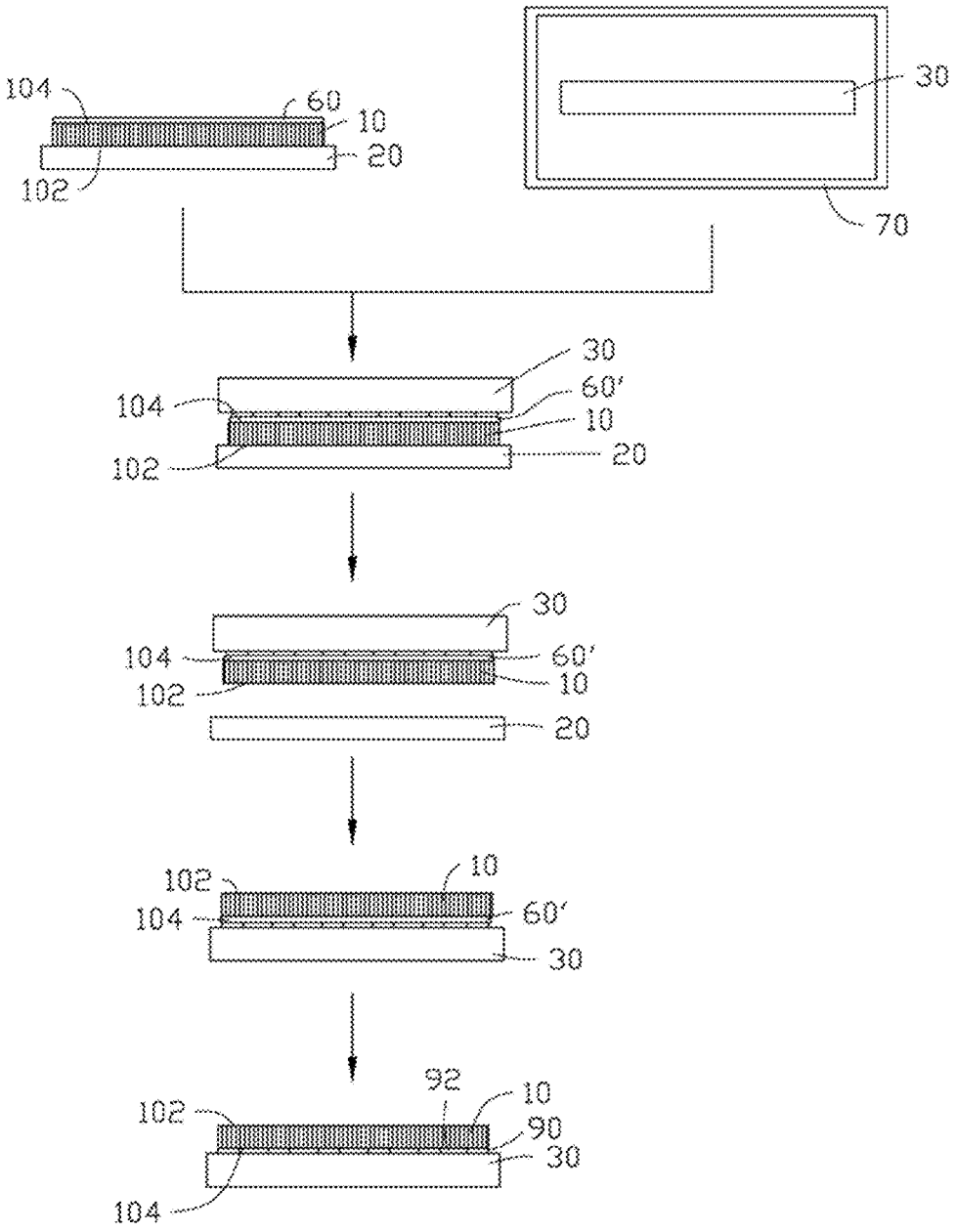
FIG. 9 is a schematic structural view of yet another embodiment of the method for transferring the carbon nanotube array.

Referring to FIG. 9, in another embodiment, when the liquid medium 60 is formed on the second surface 104 of the carbon nanotube array 10, a temperature of the substrate 30 can be decreased to below the freezing point before contacting the substrate 30 with the liquid medium 60. For example, the substrate 30 can be kept in the area, such as the freezer 70, for a period of time until the substrate 30 reaches a temperature below the freezing point. Thus, when the substrate 30 contacts the liquid medium 60 on the second surface 104 of the carbon nanotube array 10, the liquid medium 60 can be directly frozen into solid medium 60'.

During the separating of the substrate 30 from the growing substrate 20, due to the bonding between the carbon nanotube array 10 and the substrate 30 by the solid medium 60', the separating of the two substrates can separate the carbon nanotube array 10 from the growing substrate 20. During the separating, a majority of the carbon nanotubes in the carbon nanotube array 10 can be detached from the growing substrate 20 at the same time by cutting means, or moving either the substrate 30 or the growing substrate 20, or both, away from each other along a direction substantially perpendicular to the growing surface of the growing substrate 20. The carbon nanotubes of the carbon nanotube array 10 are detached from the growing substrate 20 along the growing direction of the carbon nanotubes. When both the substrate 30 and the growing substrate 20 separate, the two substrates both moves along the direction perpendicular to the growing surface of the growing substrate 20 and depart from each other.

During the removing of the solid medium 60', the solid medium 60' can be heated and melt into liquid medium, and dried between the substrate 30 and the carbon nanotube array 10. In another embodiment, the heating can directly sublimate the solid medium 60'. The removal of the solid medium 60' does not affect the state of the carbon nanotube array 10. Due to the thickness of the solid medium 60' being small, after the removal of the solid medium 60', the second surface 104 of the carbon nanotube array 10 can be in contact with the surface of the substrate 30 and bonded by van der Waals attractive forces.

For drawing the second carbon nanotube film 42, the bonding force between the carbon nanotube array 10 and the substrate 30 should be small. The bonding force is increased by the solid medium 60' to separate the carbon nanotube array 10 from the growing substrate 20 and decreased by removing the solid medium 60' before drawing the second carbon nanotube film 42. Thus, the material of the substrate 30 is not limited to PDMS and can be soft, elastic, and rigid solid materials.

Pattering of Carbon Nanotube Array

Referring back to FIG. 4 to FIG. 6, in the block S4, the laser etches the carbon nanotube array 10 to form one or more etching grooves 106 on the first surface 102. Laser beam scans on the first surface 102 and the scanned carbon nanotubes absorb the laser energy to increase the temperature thereof. The heated carbon nanotubes react with the oxygen gas in air and are burnt. Thus, the scanning of the laser beam removes some carbon nanotubes to forms the etching groove 106 on the first surface 102 of the carbon nanotube array 10. The scanning route of the laser beam can be controlled accurately by a computer, and a complicated and fine pattern of the etching grooves 106 can be formed on the first surface 102 of the carbon nanotube array 10. A power of the laser beam ranges from about 20 watts to about 50 watts and a moving speed of the laser beam ranges from about 0.1 millimeters per second (mm/s) to about 10000 mm/s. A width of the laser beam can be in a range from about 1 micron to about 400 microns.

The etching groove 106 can have a depth that is smaller than or equal to a height of the carbon nanotube array 10. In one embodiment, the depth of the etching groove 106 can be in a range from about 0.5 microns to about 10 microns. The etching groove 106 can have a width larger than or equal to 1 micron. The width and depth of the etching groove 106 is suitable for separating the carbon nanotubes in the preserving area 12 and the removing area 14. The carbon nanotubes are combined with each other by enough van der Waals attractive force to have the second carbon nanotube film 42 drawn therefrom. Thus, even the carbon nanotubes in the etching groove 106 are just shortened by the etching, the van der Waals attractive force can be decreased. Thus, during the drawing of the second carbon nanotube film 42 from the removing area 14, the carbon nanotubes in the preserving area 12 will not be drawn out with those in the removing area 14.

The etching groove 106 can have a line shape to divide the first surface 102 of the carbon nanotube array 10 into the preserving area 12 and the removing area 14. In one embodiment, the etching groove 106 forms two closed areas and the preserving area 12 and the removing area 14 are completely separated from each other by the etching groove 106. The preserving area 12 and the removing area 14 are divided according to the locations of the first electrode 90 and the second electrode 92.

In block S5, the second carbon nanotube film 42 is drawn from the removing area 14 thus removing the carbon nanotubes from the removing area.

Block S5 can comprise:

selecting a carbon nanotube segment having a predetermined width from removing area 14 by using a drawing tool; and drawing a plurality of carbon nanotube segments joined end to end by van der Waals attractive force by moving the drawing tool 50, thereby forming a continuous second carbon nanotube film 42.

The drawing tool can be adhesive tape, pliers, tweezers, or other tool allowing multiple carbon nanotubes to be gripped and pulled simultaneously.

The carbon nanotube segment comprises a single carbon nanotube or a plurality of carbon nanotubes substantially parallel to each other. The drawing tool such as adhesive tape can be used for selecting and drawing the carbon nanotube segment. The adhesive tape may contact with the carbon nanotubes in the carbon nanotube array to select the carbon nanotube segment. The drawing tool can select a large width of carbon nanotube segments to form the carbon nanotube film, or a small width of the carbon nanotube segments to form the carbon nanotube wire.

An angle between a drawing direction of the carbon nanotube segments and the growing direction of the carbon nanotubes in the carbon nanotube array 10 can be larger than 0 degrees (e.g., 30° to 90°).

In the block S5, when drawing to the edge of the removing area 14, due to the etching groove 106, the second carbon nanotube film 42 will naturally separate from the carbon nanotube array 10. The carbon nanotubes in the preserving area 12 are thus left on the substrate 30 to form the supporting members 80.

In block S5, the second carbon nanotube film 42 is drawn from the carbon nanotube array 10 that was transferred to the substrate 30, not from the carbon nanotube array 10 located on the growing substrate 20. The second carbon nanotube film 42 can be drawn from the carbon nanotube array 10 upside down on the surface 302 of the substrate 30 (e.g., drawn from the first surface 102 of the carbon nanotube array 10).

Block S5 is different from the separating of the carbon nanotube array 10 as a whole from the growing substrate 20. The carbon nanotube array 10 separated from the growing substrate 20 still in the array shape. The purpose of block S5 is to draw out carbon nanotubes one by one or segment by segment to form a carbon nanotube film or wire from the carbon nanotube array 10 on the substrate 30.

In Block S6, the first carbon nanotube film 40 is placed on the supporting members 80 and the carbon nanotubes in the first carbon nanotube film 40 are substantially aligned along a direction from one supporting member 80 to the other supporting member 80.

Depending on the embodiment, certain blocks/steps of the methods described may be removed, others may be added, and the sequence of blocks may be altered. It is also to be understood that the description and the claims drawn to a method may comprise some indication in reference to certain blocks/steps. However, the indication used is only to be viewed for identification purposes and not as a suggestion as to an order for the blocks/steps.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A thermoacoustic device comprising:

a substrate comprising a surface;

a first electrode and a second electrode located on the surface and spaced from each other;

at least two supporting members spaced from each other and respectively located on surfaces of the first electrode and the second electrode, the at least two supporting members comprises a plurality of carbon nanotubes parallel with each other and substantially perpendicular to the surface of the substrate; and a first carbon nanotube film supported by the at least two supporting members and comprising a portion between the at least two supporting members that is suspended above the substrate, and the at least two supporting members electrically connecting the first carbon nanotube film with the first electrode and the second electrode.

2. The thermoacoustic device of claim 1, wherein each of the at least two supporting members is a carbon nanotube array.

3. The thermoacoustic device of claim 2, wherein the carbon nanotube array has an ability to have a second carbon nanotube film drawn therefrom, and the second carbon nanotube film comprises a plurality of carbon nanotubes joined end to end.

4. The thermoacoustic device of claim 1, wherein a height of each of the at least two supporting members is in a range from 10 microns to 5 millimeters.

5. The thermoacoustic device of claim 1, wherein a length of each of at least two supporting members is larger than or equal to a width of the first carbon nanotube film.

6. The thermoacoustic device of claim 1, wherein a width of each of at least two supporting members is in a range from 5 microns to 1 millimeter.

7. The thermoacoustic device of claim 1, wherein the first carbon nanotube film is a thermoacoustic sound wave generator.

8. The thermoacoustic device of claim 1, wherein the first carbon nanotube film is drawn from a carbon nanotube array.

9. The thermoacoustic device of claim 1, wherein the substrate is electrically insulating.

10. The thermoacoustic device of claim 1, wherein an insulating layer is located between the substrate and the first electrode and second electrode to electrically insulate the first electrode and second electrode from the substrate.

11. The thermoacoustic device of claim 1, wherein a thicknesses of the first electrode and a thicknesses of the second electrode are both in a range from 1 micron to 1 millimeter.

* * * * *